United States Patent [19]

Astill

[11] 4,207,453

[45] Jun. 10, 1980

[54] METHOD OF PRODUCING SEAM WELDED TUBE

[75] Inventor: Cyril J. Astill, Deep River, Canada

[73] Assignee: Canadian Patents & Development Ltd., Ottawa, Canada

[21] Appl. No.: 949,768

[22] Filed: Oct. 10, 1978

[30] Foreign Application Priority Data

Jan. 16, 1978 [CA] Canada ..... 295021

[51] Int. Cl.[2] ..... B23K 31/06; B23K 9/02; B21B 17/06

[52] U.S. Cl. ..... 219/61.11; 219/160; 219/161; 228/17.5; 72/370

[58] Field of Search ..... 219/61.1, 61.11, 160, 219/161; 228/17.5; 72/370

[56] References Cited

U.S. PATENT DOCUMENTS

| | | | |
|---|---|---|---|
| 2,004,787 | 6/1935 | Gillette | 219/160 |
| 2,922,870 | 1/1960 | Collins et al. | 219/161 |
| 2,929,914 | 3/1960 | Ely | 219/61.11 |
| 3,609,276 | 9/1971 | Cavagnero et al. | 219/160 X |
| 3,938,797 | 2/1976 | Frederick | 219/161 X |
| 4,083,221 | 4/1978 | Whitted | 72/370 X |

FOREIGN PATENT DOCUMENTS

| | | | |
|---|---|---|---|
| 741938 | 5/1970 | Belgium | 219/61.11 |
| 411940 | 9/1974 | U.S.S.R. | 228/17.5 |

*Primary Examiner*—B. A. Reynolds
*Assistant Examiner*—Keith E. George
*Attorney, Agent, or Firm*—Francis W. Lemon

[57] ABSTRACT

A method of seam welding metal tube from a sheet metal blank wherein the sheet metal blank is provided with central key locating slots and pre-curled edges, then centrally located on a collapsible mandrel, having a heat sink liner extending therearound to a longitudinally extending gas gallery slot, by the key locating slots and then skid rolled therearound towards a longitudinally extending gas gallery slot for seam welding the curled edges while they are clamped to the collapsible mandrel over the gas gallery slot. Pre-curling the edges avoids upstanding edges at the seam weld and the method provides consistently reliable welds for tube blanks which may be manufactured in short lengths for, for example, the manufacture of bellows.

1 Claim, 18 Drawing Figures

METHOD OF PRODUCING SEAM WELDED TUBE

Figure 1:
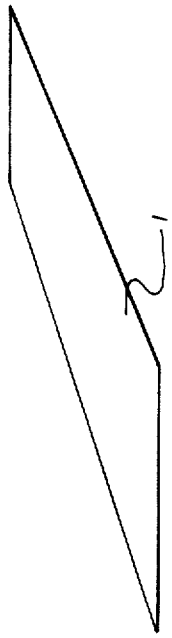

This invention relates to a method of producing a seam welded metal tube.

It is known to form a seam welded metal tube from strip by:

(i) drawing the strip through a series of plastic boats which progressively shape the strip towards a tube, (ii) closing the longitudinal edges together by means of forming rollers to form a tube, and (iii) seam welding the longitudinal edges as the tube passes through a sizing, heat sink bushing.

This process is known as the "German mill tube welding machine" and while it has proved to be useful, it has a disadvantage in that the tube forming plastic boats and particularly the heat sink bushing wear and allow marginal edge portions that should be abutting to stand apart like the partially raised sides of a drawbridge or to be misaligned with the result that an unreliable weld can occur.

According to the present invention there is provided a method of producing a seam welded metal tube, comprising:

(a) providing a rectangular shaped sheet metal blank with key locating slots in a first pair of opposed edges thereof, the key locating slots being centrally located between a second pair of opposed edges of the sheet metal blank, (b) machining the second pair of opposed edges of the sheet metal blank to size using the key locating slots to position the sheet metal blank during machining, (c) forming marginal edge portions of the second pair of opposed edges of the sheet metal blank to substantially the curvature of the finished tube, (d) centrally locating the sheet metal blank to a collapsible mandrel by means of keys in the key locating slots, so that the formed marginal edge portions curve around the curved surface of the collapsible mandrel towards a longitudinally extending gas gallery slot in the mandrel, (e) clamping a central portion of the sheet metal blank extending between the key locating slots around the collapsible mandrel by means of a cradle, then (f) with the collapsible mandrel expanded, rolling the sheet metal blank therearound, by means of skid rollers, from each side of the key locating slots to form a tube with the second pair of opposing edges abutting over the gas gallery slot in the collapsible mandrel, then (g) with the skid rollers holding the rolled sheet metal blank against the collapsible mandrel, clamping the formed marginal edge portions against the collapsible mandrel by curved portions of spring metal heat sink finger strips secured in substantially V-shaped slots in the skid rollers, with the clamping force being applied by fluid pressure in tubes of an elastic material in the substantially V-shaped slots and on the convex side of the curved portions of the finger strips. then (h) seam welding the second pair of opposing edges of the sheet metal blank with an inert gas shielded seam welding device, while feeding inert gas to the gas gallery slot, to form a seam welded tube, and then (i) collapsing the collapsible mandrel from the welded tube to separate the collapsible mandrel therefrom.

Figure 2:
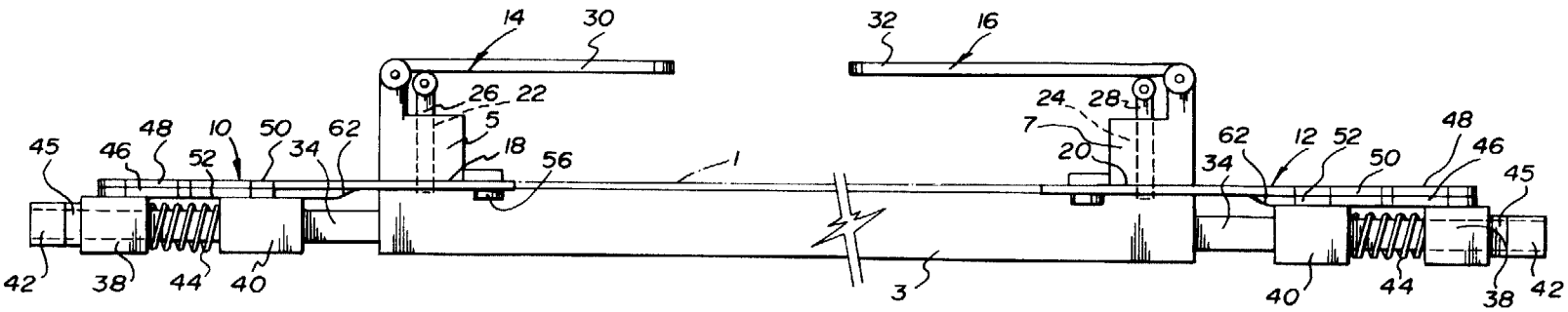
Figure 3:
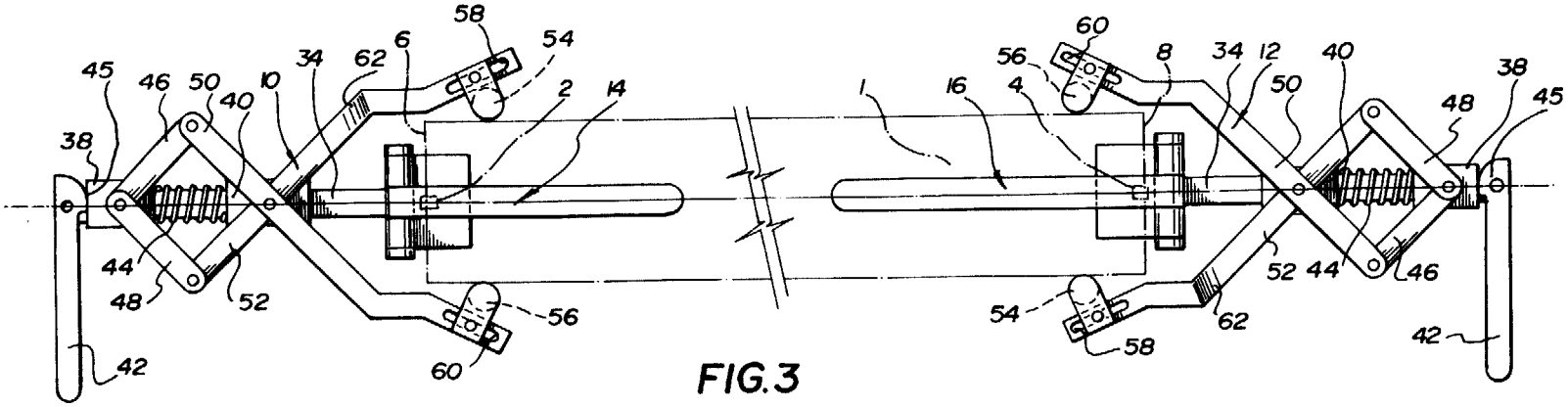
Figure 5:
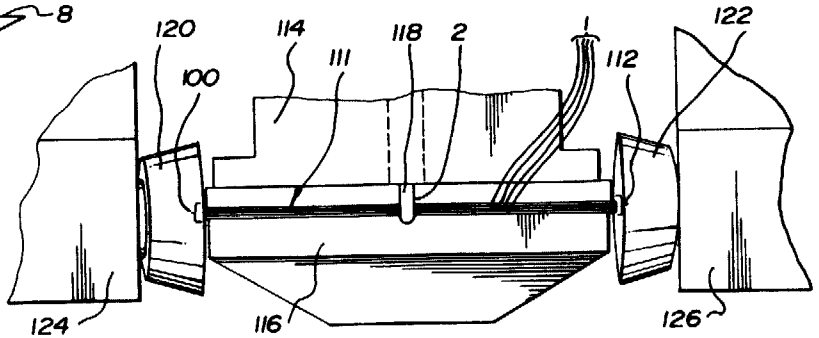
Figure 4:
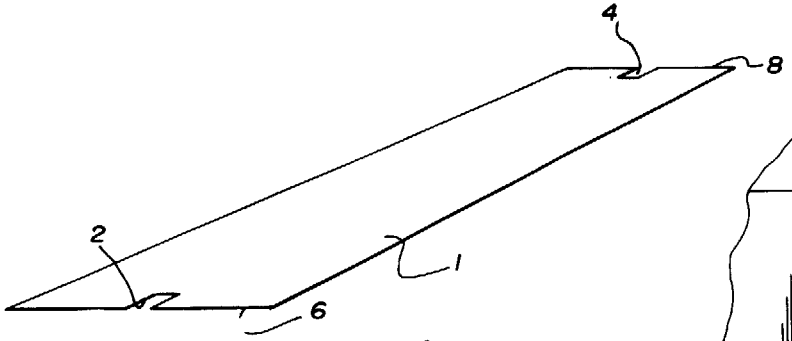
Figure 6:
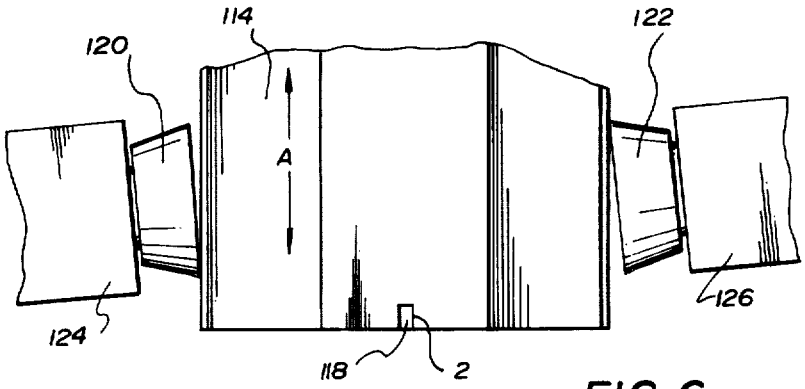
Figure 7:
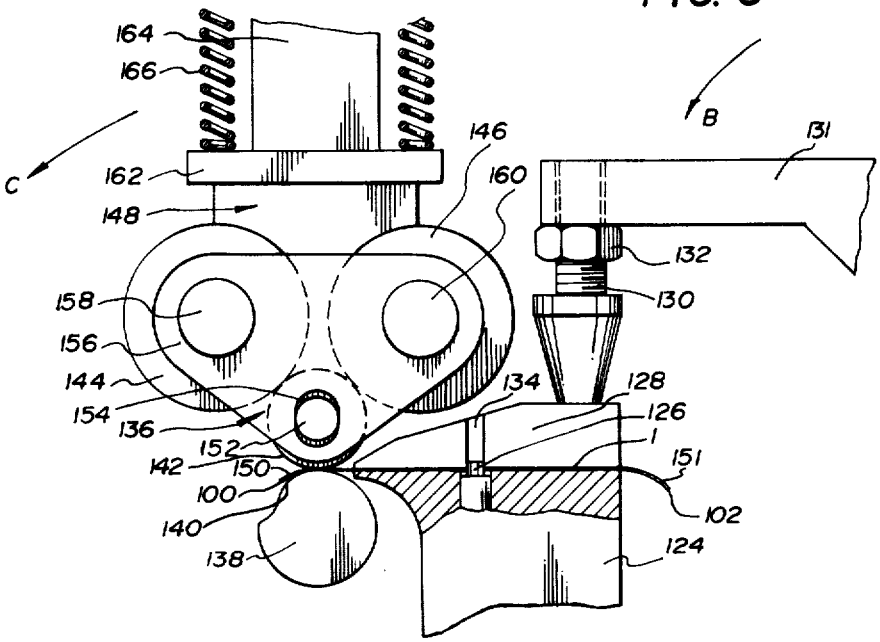
Figure 8:
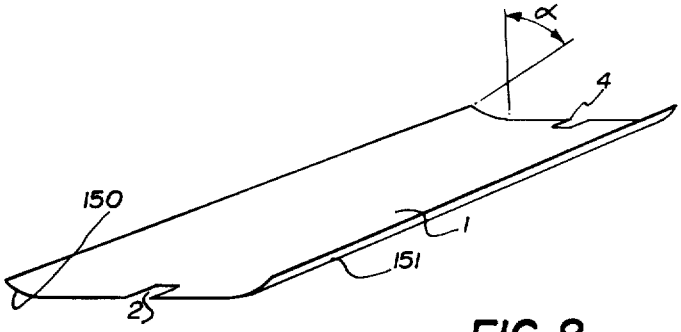
Figure 9:
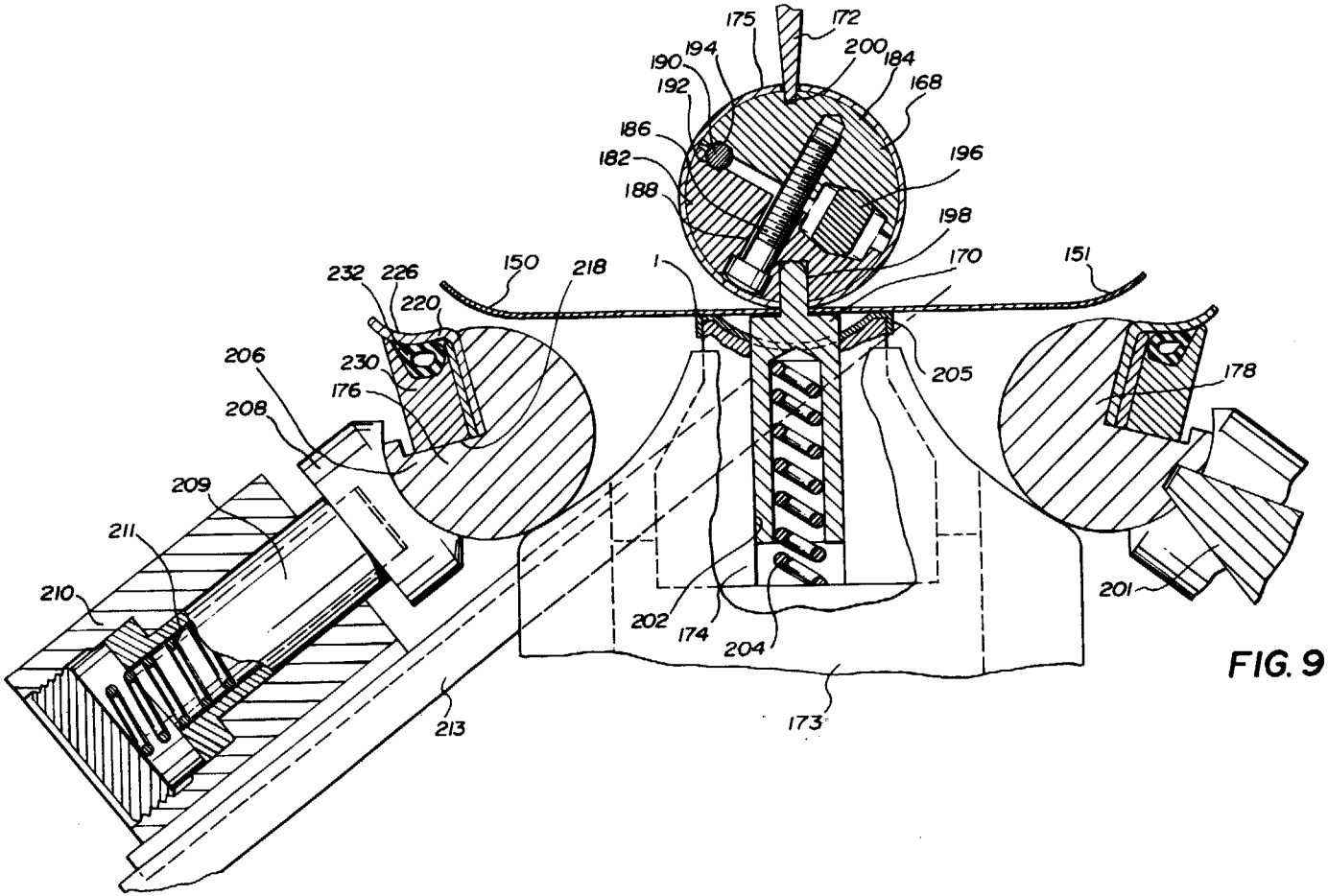
Figure 10:
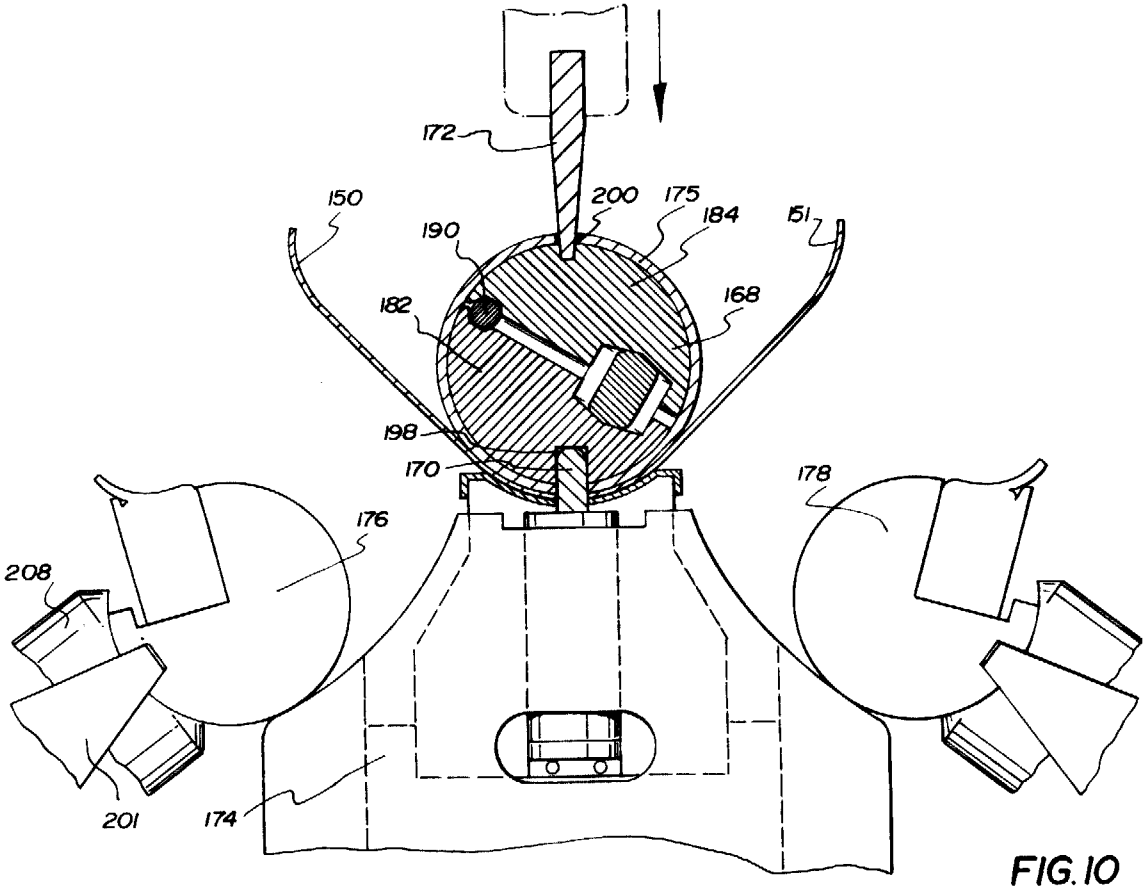
Figure 11:
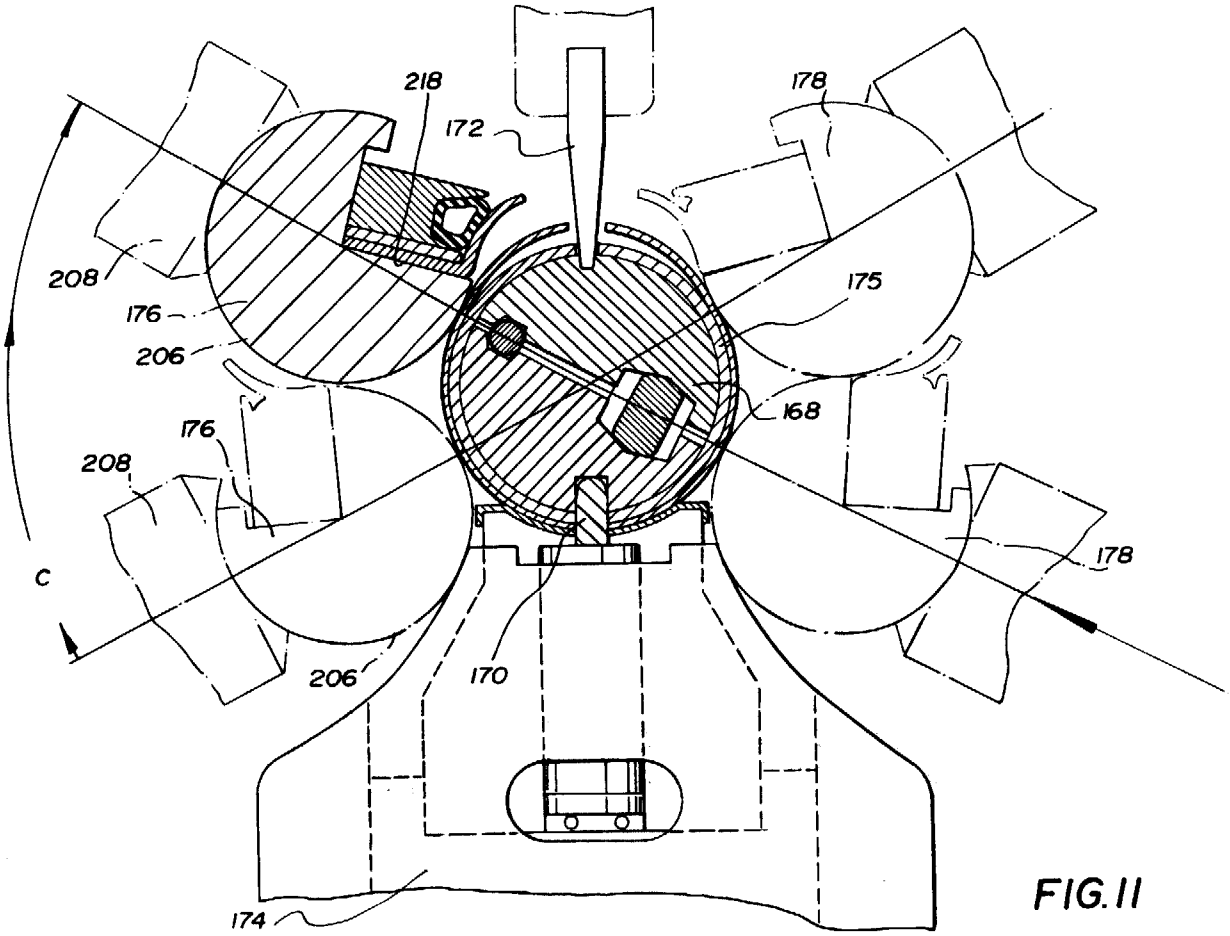
Figure 12:
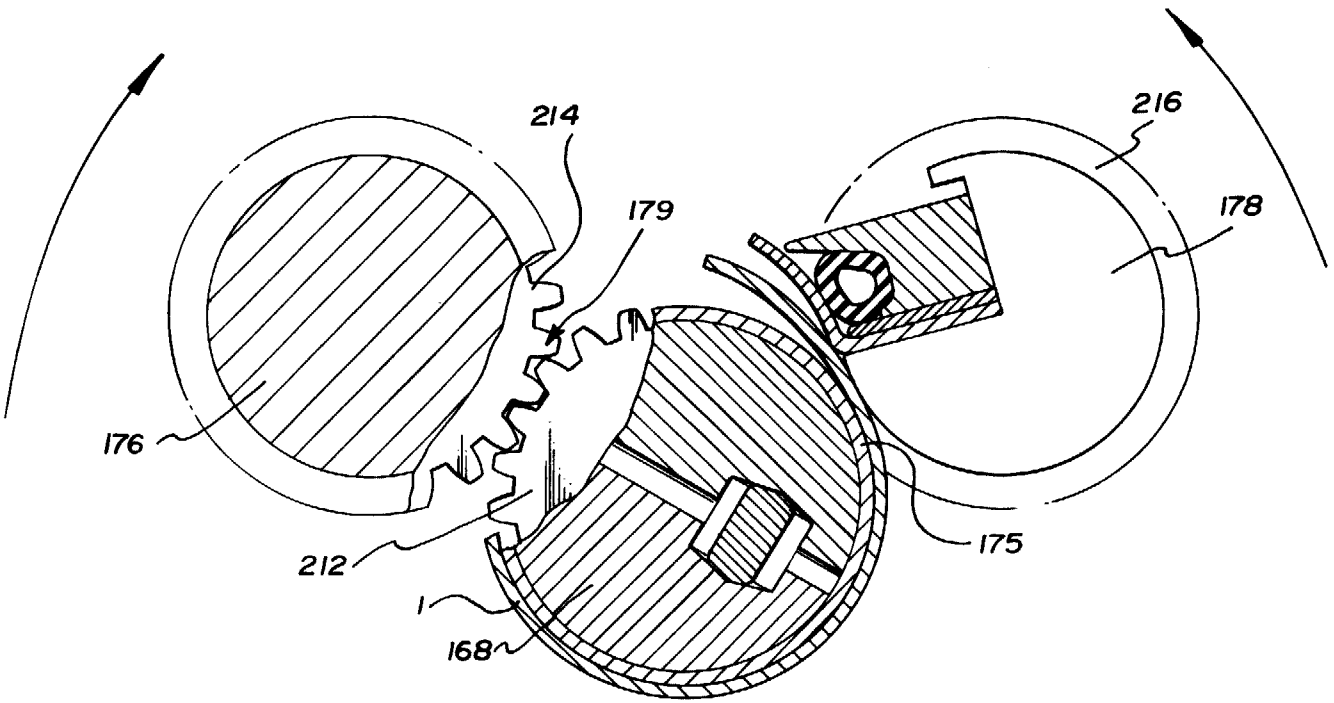
Figure 13:
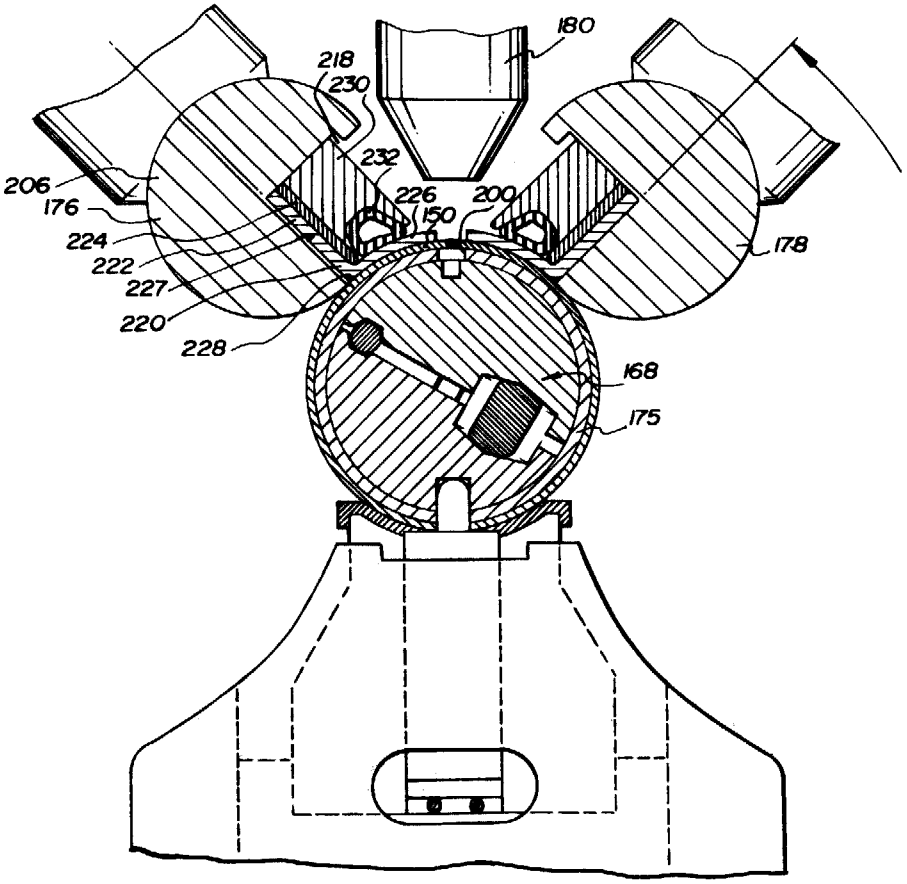
Figure 14:
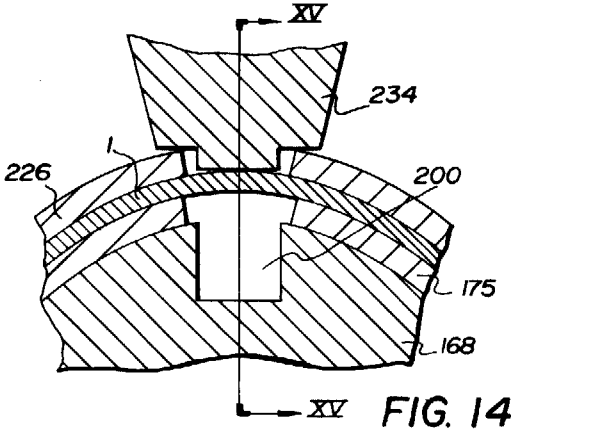
Figure 16:
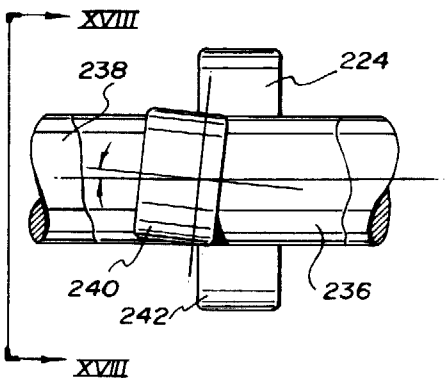
Figure 18:
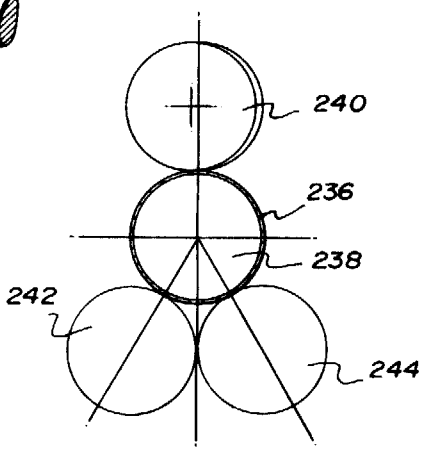
Figure 15:
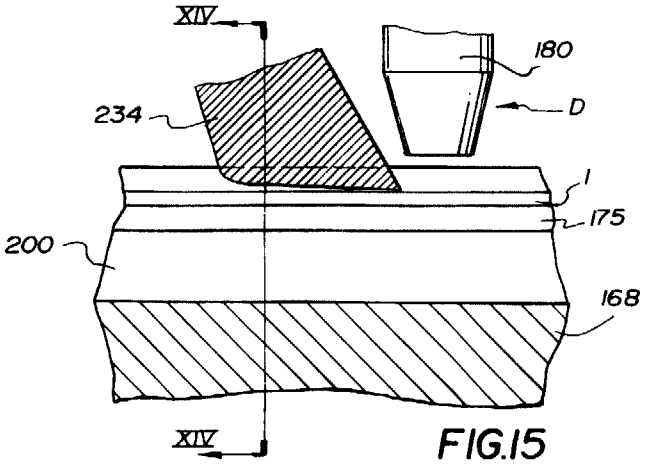
Figure 17:
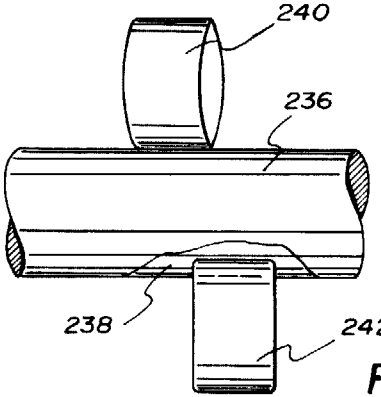

In the accompanying drawings which illustrate by way of example, an embodiment of the present invention, FIG. 1 is an isometric view of a sheet metal blank, FIG. 2 is a side view of an apparatus for providing the sheet metal blank (shown chain dotted) shown in FIG. 1 with key locating slots, FIG. 3 is a plan view of FIG. 2, FIG. 4 is an isometric view of the sheet metal blank shown in FIG. 1 provided with key locating slots, FIG. 5 is an end view of an apparatus for accurately grinding the edges to be welded of a stack of the metal strip blanks shown in FIG. 4, FIG. 6 is a plan view of a portion of one end of the apparatus shown in FIG. 5, FIG. 7 is an end view of an apparatus for providing one of the sheet metal blanks shown in FIGS. 5 and 6 with marginal edge portions formed to substantially the curvature of the finished tube, FIG. 8 is an isometric view of the sheet metal blank shown in FIG. 6 provided with the curved, marginal edge portions, FIG. 9 is a sectional end view of the sheet metal blank shown in FIG. 8 centrally located by the key locating slots to a collapsible mandrel of a sheet metal blank tube forming and welding apparatus, FIG. 10 is a similar sectional end view to that shown in FIG. 9, with a central portion of the sheet metal blank extending between the key locating slots clamped between the collapsible mandrel and a cradle by a clamping beam, FIG. 11 is a similar sectional end view to that shown in FIG. 10, with the sheet metal blank being rolled around the collapsible mandrel by skid rollers to a position where the clamping beam is removed, FIG. 12 is a partly sectioned end view showing a gear mechanism for skid rolling the skid rollers around the collapsible mandrel and for locking heat sink fingers in a clamping position, FIG. 13 is a similar cross-sectional end view to that shown in FIG. 11, with the skid rollers at rest at the clamping position at which point heat sink fingers pneumatically clamp the sheet metal blank to form a rolled metal tube, and an inert gas shielded seam welding device is positioned over butting edges of the sheet metal blank, FIG. 14 is a cross-sectional end view along XIV—XIV of FIG. 15, of portions of the collapsible mandrel, the rolled metal tube, a liner, the heat sink fingers and a shoe, FIG. 15 is a sectional side view along XV—XV of FIG. 14, showing the inert gas shielded seam welded device preceded by the shoe, FIG. 16 is a plan view of a planishing roll assembly for progressively flattening the seam weld, FIG. 17 is a side view of FIG. 16, and FIG. 18 is an end view along XVIII—XVIII, FIG. 16.

In FIG. 1 there is shown a sheet metal blank 1.

The apparatus shown in FIGS. 2 and 3 is used to provide the sheet metal blank 1 (shown chain-dotted) of FIG. 1 with the centrally located, key locating slots 2 and 4 shown in FIG. 4. The key locating slots 2 and 4 are provided in a first pair of opposing edges 6 and 8 respectively of the sheet metal blank 1.

The apparatus comprises a bed 3 provided with end pillars 5 and 7, spring loaded tong assemblies generally designated 10 and 12 and key locating slot punch assemblies generally designated 14 and 16.

The bed width is slightly smaller than the width of the sheet metal blank 1 and the end pillars 5 and 7 have slots 18 and 20 respectively for longitudinally locating the sheet metal blank on the bed 3. The pillars 5 and 7 are each provided with a punch slot 22 and 24 respectively, within which punches 26 and 28 of the key locating slot punch assemblies 14 and 16 are slidable vertically. The pillars 5 and 7 have levers 30 and 32 respectively of the key locating slot punch assemblies 14 and 16, pivotally attached to them for urging the punches 26 and 28 downwardly.

The spring loaded tong assemblies 10 and 12 are identical and so similar parts of the spring loaded tong assemblies 10 and 12 are designated by the same reference numerals and a description of the spring loaded tong assembly 10 will suffice for both of them.

The spring loaded tong assembly 10 comprises a square shaft 34 which is attached to the bed 3. Sleeve 38 is slidable on the shaft 34. A fixed sleeve 40 is fixed on the shaft 34 so as not to slide therealong. End flange 38 has a lever 42 (FIG. 3) pivotally attached thereto. A compression spring 44 is around the shaft 34 and urges the sleeve 38 against cam shaped protrusions 45 on the lever 42. When the lever 42 is actuated the cam shaped protrusions 45 urge the sleeve 38 toward the fixed sleeve 40.

The sleeve 38 has the ends of two links 46 and 48 pivotally attached thereto while the sleeve 40 has intermediate portions of two links 50 and 52 pivotally attached thereto. The other ends of the links 46 and 48 are pivotally attached to ends of the links 50 and 52 respectively. The free ends of the links 50 and 52 have fingers 56 and 54 respectively adjustably attached thereto through slots 60 and 58 respectively. The link 50 is suitably shaped at 62 so that it can be used with a range of blank sizes.

With the fingers 54 and 56 held apart by the cam shaped protrusions 45, a setting gauge (not shown), which is the same size and shape as the sheet metal blank shown in FIG. 4, is placed between the fingers 54 and 56 of the spring loaded toggle assemblies 10 and 12 and is centrally located by the punches 26 and 28 locating in the slots 2 and 4 of the setting gauge, The fingers 54 and 56 are then released by operating the levers 42 and are positioned and locked along the slots 58 and 60 respectively so that the setting gauge is centrally positioned on the bed 3 with the punches 26 and 28 removed. This is an initial setting procedure. Using the levers 42 the setting gauge is then replaced by the sheet metal blank 1 shown in FIG. 1 and the levers 30 and 32 are depressed to punch the key locating slots 2 and 4 shown in FIG. 4.

FIGS. 5 and 6 show an apparatus for accurately grinding the edges to be welded to a stack 111 of the sheet metal blanks 1 shown in FIG. 3. The edges to be welded comprise a second pair of opposed edges 100 and 112 of each sheet metal blank 1.

In FIGS. 5 and 6 a clamping plate 114 holds a stack 111 of approximately twelve of the sheet metal blanks 1 in position on a traversing table 116 while keys, such as key 118, secured to each end of the traversing table 116 accurately locate the stack 111 and the clamping plate 114, using the key locating slots 2 and 4, with respect to the traverse in directions A (FIG. 6) of the traversing table 116. A pair of grinding wheels 120 and 122 mounted on conventional mounts 124 and 126 respectively.

With the stack 111 secured on the base 116 in this manner the grinding wheels 120 and 122 are rotated and the traversing table is moved in the directions of traverse A to accurately grind the second pair of opposed edges 100 and 112 of each sheet metal blank 1 to size with respect to the key locating slots 2 and 4. Thus the sheet metal blanks 1 are machined to size using the key locating slots 2 and 4 to position the sheet metal blank during machining.

FIG. 7 shows a base 124 with keys, one of which is shown and designated 126, for locating in the key locating slots 2 and 4 of one of the sheet metal blanks 1 of FIG. 4 which has had the second pair of opposed edges 100 and 102 ground. A clamping plate 128 presses the sheet metal blank 1 against the base 124 by a conventional toggle clamp a portion of which is shown and designated 131. The toggle clamp 131, which swings in direction B, is adjusted by means of a screw 130 in a bracket 131 and the screw 130 is locked in position by a lock nut 132. The clamping plate 128 has slots, one of which is shown and designated 134, for positioning it on the base 124 by means of the keys such as key 126.

The roll assembly 136 comprises a former bar 138, which has a circumferentially extending portion 140 of its surface provided with a smaller radius of curvature than the remainder which has the desired radius of curvature of the finished tube, and a floating roller 142 with two back-up rollers 144 and 146 all mounted in a spring loaded carriage generally designated 148 for rolling marginal edge portions 150 and 151 of the sheet metal blank 1.

The floating roller 142 is mounted to freely rotate on a shaft 152 which floats in elongated slots, one of which is shown and designated 154 in side arm 156, forming each end of the spring-loaded carriage 148. The back-up rollers 144 and 146 are mounted to freely rotate in the side arms, such as side arm 156, of the spring loaded carriage 148 by shafts 158 and 160 respectively.

The spring loaded carriage 148 comprises side arms, such as side arm 156, attached to a cross-beam 162, and a vertically slidable shaft 164 attached to the cross-beam 162 and spring-loaded by a spring 166. The spring loaded carriage 148 is mounted in a conventional manner to be moved manually in direction C around the longitudinal axis of the former bar 138.

The sheet metal blank 1 is clamped on the base 124 by the clamping plate 128 and located thereon by the keys such as key 126 and with the roller assembly 136 in the position shown in FIG. 7. The roller assembly 136 is then rolled in the direction C to bend the marginal edge portion 150 of the sheet metal blank round the former bar. The sheet metal blank is then removed from the base 124 and replaced thereon for rolling the marginal edge portion 151 in the same manner by the roller assembly 136.

The circumferentially extending portion 140 of the surface of the former bar 138, which has a smaller radius causes extreme edge portions of the sheet metal blank 1 to be rolled around a smaller radius than that of the final tube and this avoids the extreme edge portions from remaining flat as would be the case if the extreme edge portions were not rolled around the smaller radius. Thus, as shown in FIG. 8, the sheet metal blank 1 is provided with marginal edge portions 150 and 151 having substantially the radius of curvature of the finished tube.

In practice a rolled arcuate marginal edge portion extending round an angle $\alpha$ of 30° has been found to be adequate.

FIGS. 9 to 13 show a collapsible mandrel generally designated 168, retractable keys, one of which is shown and designated 170, clamping beam 172, a bed 173, a cradle 174, a heat sink liner 175, skid roller assemblies 176 and 178, a gear mechanism 179 (FIG. 12), and an inert gas seam welding device 180 (FIG. 13).

The collapsible mandrel 168, which is located on the retractable keys, such as retractable key 170 by key locating slots such as key locating slot 198, comprises two segments 182 and 184 secured together by a plurality of bolts 186 which extends through clearance holes 188 in segment 182 and are screwed into segment 184. The bolts 186 hold the segments 182 and 184 together with a pivot rod 190 trapped between them in shallow grooves 192 and 194 and a rotatable cam 196 for swinging the segments apart about the pivot rod 190. The segment 182 has key locating slots at each end, one of which is shown and designated 198, and the segment 184 has a longitudinally extending slot 200 forming a gas gallery and beam locating slot therealong.

The retractable keys are identical and so a description of the retractable key 170 will suffice for both of them. The retractable keys are positioned to locate in the key locating slots 2 and 4 (FIG. 8) in the sheet metal blank 1 and the key locating slots, such as key locating slot 198, in the collapsible mandrel 168.

The retractable key 170 is slidably mounted in a slot 202 in the cradle 174 and supported in a raised position therein by an open coil compression spring 204.

The cradle 174 is mounted in the bed 173.

The clamping beam 172 is removably mounted in a conventional manner (not shown) for vertical movement so that the clamping beam can, after the heat sink liner 176 has been placed on the collapsible mandrel 168, push the collapsible mandrel 168 from the position shown in FIG. 9 downwardly into the cradle 174 by displacing the retractable keys one of which is shown and designated key 170. The clamping beam 172 is removable in order that the welding torch can be moved into the operating position shown in FIG. 12.

The cradle 174 may be provided with a removable cradle liner 205.

The skid roller assemblies 176 and 178 are identical and so a description of one of them will suffice for both of them.

The skid roller assembly 176 comprises a skid roller 206 mounted on a plurality, in this embodiment four, pressure pads 208 at spaced intervals along the skid roller 206. The skid roller assemblies 176 and 178 are radially located in the withdrawn position shown in FIG. 9 by spring loaded keys 201 to ensure correct timing engagement of gears 214 and 216 (FIG. 12) with gear 212 when advanced to the position shown in FIG. 11. The pressure pads 208 are each attached to a piston 209 which is spring loaded in a cylinder 210 by a spring 211. The cylinder 210 is mounted on an arm 213 rotatably secured on the centerline of the collapsible mandrel 168. Thus the skid roller 206 is mounted for moving, in from the position shown in FIG. 9 to the position shown chain-dotted in FIG. 11, and then for skid rolling the sheet metal strip blank 1 through an arc around the collapsible mandrel 168 in the direction C by the gear mechanism 179 (FIG. 12) to the position shown in FIG. 13, so that the sheet metal blank 1 is drawn tightly around the collapsible mandrel 168. Preferably both of the skid rollers such as skid roller 206 perform this operation at the same time.

The gear mechanism 179 FIG. 12, comprises two stationary gears, one of which is shown and designated 212, each located on brackets (not shown) on the bed 173 and just beyond each end of and on the same centerline as the collapsible mandrel 168, and four gears, two of which are shown and designated 214 and 216 secured to the ends of the skid rollers, such as skid roller 206, for rotation therewith. When the skid rollers, such as skid roller 206, reach the position shown chain-dotted in FIG. 11 the teeth of the gears such as those shown and designated 214 and 216 (FIG. 12) become meshed with the teeth of the gears one of which is shown and designated 212. The gears such as the gear designated 212 are held stationary so that the gears such as gears 214 and 216 cause the skid rollers such as skid roller 206 to be rolled around the collapsible mandrel 168. The skid rollers such as skid roller 206 skid round the outer surface of the sheet metal blank 1 because the outside diameter of the sheet metal blank 1 when drawn tightly around the collapsible mandrel 168 is greater than the pitch circle diameters of the gears such as gear 212, and the diameters of the skid rollers such as skid roller 206 are less than the pitch circle diameters of the gears such as those designated 214 and 216.

The skid roller 206 has, as shown for example in FIGS. 11 and 13, a radially inwardly extending, substantially V-shaped slot 218 containing a spring metal heat sink finger strip, in this instance of beryllium copper, 220 having a radially extending portion 222, secured to one side of the substantially V-shaped slot 218, by a plate 224 and a curved portion 226 extending over a portion of the substantially V-shaped slot 218 and curved to substantially the external curvature of the sheet metal blank 1 when held tightly around the collapsible mandrel 168. The plate 224 holds all of the radially extending portion 222 to one side 227 of the V-shaped slot 218 so that the corner 228 of the spring strip 220 is held against displacement. As shown in FIG. 13 the side 227 of the substantially V-shaped slot 218 extends radially with respect to the longitudinal axis of the collapsible mandrel 168. A cradle support 230 in the substantially V-shaped slot 218 supports a tube 232 of an elastic material, in this instance rubber, against a more or less central portion of the convex side of the curved portion 226 of the spring strip 220. The tube 232 is connected to a source (not shown) of pressurized fluid, in this instance air at 150 lbs./squ. in (970 squ. cm). When the skid roller 206 has come to rest after skid rolling through the arc C (FIG. 11), the clamping beam 172 is removed and the skid rollers advance to the position shown in FIG. 13 so that the curved portion 226 of the spring strip rests upon a marginal edge portion of the strip blank 1. The tube 232 is then inflated so that the curved portion 226 presses the marginal edge portion 150 firmly against collapsible mandrel 168.

With the sheet metal blank 1 held tightly around the collapsible mandrel 168 the welding device 180 and a spring loaded shoe 234 (FIGS. 14 and 15) are moved into position. The spring loaded shoe 234 is wiped across the butted edges just ahead of the welding device 180 to ensure perfectly matched butted edges, during welding. Inert gas is fed to the slot 200 during welding. In this instance the welding device 180 is an argon gas shielded, arc welding device and argon gas is fed to the slot 200 during welding.

In operation the edges of the sheet metal blank 1 are seam welded in the direction D, FIG. 15. The heat sink liner 175 and curved portion 226 of each spring strip 220 is of a high thermal conductivity metal to dissipate welding heat. The accurate positioning of the clamping edges of the heat sink liner 175 and fingers 226 either side of the butted edges is very important. The skid rollers of the skid roller assemblies are then moved to the positions shown in FIG. 9 and then the collapsible mandrel 168 is removed from the cradle 174 after removing the welding device 180 and the shoe 234. The collapsible mandrel 168 is then removed from the seam welded tube.

Preferably the seam welded tube 236 (FIGS. 16 to 18) has a finishing mandrel 238 inserted therein and is rolled to the finished size by rotatably driven planishing roller 240 which progressively sizes the seam welded tube 236 against freely rotating back up rollers 242 and 244. The planishing roller 240 flattens any upstanding portion of the seam weld. This is an optional operation which may be used where it is desirable to obtain the most uniform wall thickness tube.

The present invention is particularly useful for producing seam welded tube blanks for the manufacture of tubular bellows.

For the manufacture of multi-ply bellows, the different plies can be manufactured using the same apparatus by providing a number of liners 175 (FIG. 9) of different thicknesses, to obtain the telescoping tubes, and a number of cradle liners 205 of appropriate thicknesses to locate the collapsible mandrel 168 on the same center as the fixed gear 212 during the manufacture of each telescoping tube.

I claim:

1. A method of producing a seam welded metal tube, comprising:

(a) providing a rectangular shaped sheet metal blank with key locating slots in a first pair of opposed edges thereof, the key locating slots being centrally located between a second pair of opposed edges of the sheet metal blank, (b) machining the second pair of opposed edges of the sheet metal blank to size using the key locating slots to position the sheet metal blank during machining, (c) forming marginal edge portions of the second pair of opposed edges of the sheet metal blank to substantially the curvature of the finished tube.

(d) centrally locating the sheet metal blank to a collapsible mandrel by means of keys in the key locating slots, so that the formed marginal edge portions curve around the curved surface of the collapsible mandrel towards a longitudinally extending gas gallery slot in the mandrel, (e) clamping a central portion of the sheet metal blank extending between the key locating slots around the collapsible mandrel by means of a cradle, then (f) with the collapsible mandrel expanded, rolling the sheet metal blank therearound, by means of skid rollers, from each side of the key locating slots to form a tube with the second pair of opposing edges abutting over the gas gallery slot in the collapsible mandrel, then (g) with the skid rollers holding the rolled sheet meltal blank against the collapsible mandrel, clamping the formed marginal edge portions against the collapsible mandrel by curved portions of spring metal heat sink finger strips secured in substantially V-shaped slots in the skid rollers, with the clamping force being applied by fluid pressure in tubes of an elastic material in the substantially V-shaped slots and on the convex side of the curved portions of the finger strips, then (h) seam welding the second pair of opposing edges of the sheet metal blank with an inert gas to the gas gallery slot, to form a seam welded tube, and then (i) collapsing the collapsible mandrel from the welded tube to separate the collapsible mandrel therefrom.

* * * * *